United States Patent [19]

Collier

[11] Patent Number: 4,927,372

[45] Date of Patent: May 22, 1990

[54] ELECTRICAL CONNECTOR

[75] Inventor: John C. Collier, Southport, United Kingdom

[73] Assignee: ITT Industries Limited, Basingstoke, United Kingdom

[21] Appl. No.: 312,831

[22] Filed: Feb. 21, 1989

[30] Foreign Application Priority Data

Feb. 19, 1988 [GB] United Kingdom ..... 8802893

[51] Int. Cl.[5] ..... H01R 9/09

[52] U.S. Cl. ..... 439/83; 439/247; 439/78

[58] Field of Search ..... 439/78, 83, 387, 733, 439/869, 80, 81, 246, 247, 248, 876, 885

[56] References Cited

U.S. PATENT DOCUMENTS

| | | | |
|---|---|---|---|
| 4,660,911 | 4/1987 | Reynolds et al. | 439/80 |
| 4,664,458 | 5/1987 | Worth | 439/248 X |
| 4,854,882 | 8/1989 | Corridori | 439/246 |

*Primary Examiner*—Steven C. Bishop

*Attorney, Agent, or Firm*—Thomas L. Peterson

[57] ABSTRACT

A connector for a printed circuit board (9) comprises a housing (1) containing contacts (5,6,7). The housing is fixed to the board by the engagement of splined pins (4) at either end, in corresponding holes 11 in the board. As the connector is pressed down onto the board, the contacts engage contact surfaces (10) on the latter and are pushed back into the housing. A layer (8) of frictional material, through which the contacts pass retains them in their adjusted position during subsequent handling and soldering. The contacts can have lower ends of different profiles of which three are shown.

8 Claims, 1 Drawing Sheet

ELECTRICAL CONNECTOR

Figure 1:
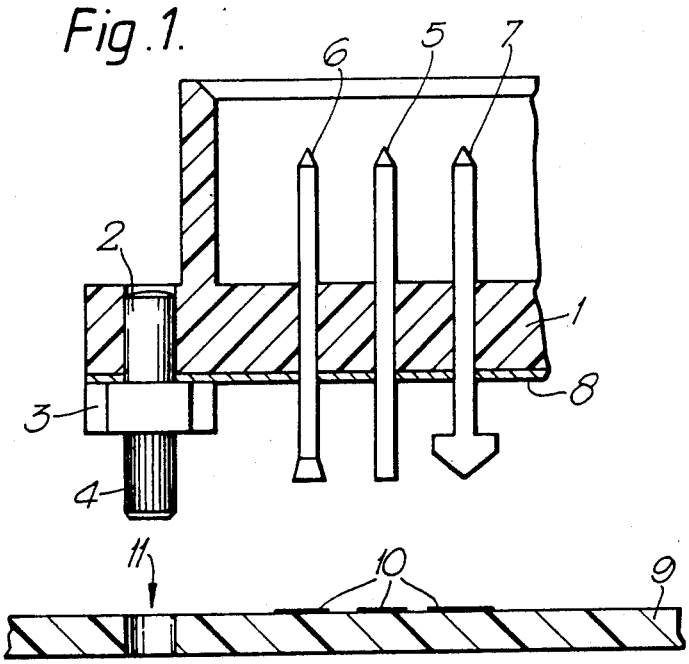

This invention relates to a connector for a printed circuit board, and more particularly, but not exclusively, to connectors such as 64 and 96 Way DIN connectors. The invention is also applicable to connectors having a smaller number of contacts or as many as several hundred contacts.

Din connectors have heretofore been mainly secured to printed circuit boards by means of press fit pins inserted into plated through holes in the circuit board. It is an object of the present invention to provide a surface-mounted connector for a printed circuit board, thereby obviating the need for plated-through holes and freeing more of the surface area of the circuit board for the provision of conductor tracks or pads.

According to one aspect of the invention there is provided a connector for a printed circuit board, the connector comprising an insulating housing; a plurality of substantially rigid electrical contacts, receivied within the housing so as to be freely movable with respect thereto in one direction; and means for locating the contact elements with respect to the housing, the locating means being such that the contacts are able to move in the one direction on engagement with a printed circuit board, the locating means being adapted to hold the contact elements in any one of a range of positions in that direction.

According to another aspect of the invention there is provided a connector for a printed circuit board comprising a housing having a plurality of holes accommodating respective elongated contacts one end of which is adapted to make electrical contact with a conductive trace, pad or other conductive surface on the printed circuit board when the connector is brought into contact with the board, characterised in that the contacts are capable of limited axial movement relative to the housing in order to take up irregularities in the board and that frictional material is provided to cause the contacts to be retained in the positions which they have taken up when the connector is fully engaged with the board.

When the connector is placed against the printed circuit board, the electrical contacts move so as to accommodate irregularities in their dimensions and/or those of the printed circuit board. The contacts are free to find their own level within the housing of the connector, and can hence make good contact with even warped circuit boards. The contact elements are therefore more likely to engage the solder paste on the circuit board and thus ensure a reliable solder joint between the contacts and the contact pads on the board during a subsequent solder re-flow operation.

Preferably the locating means comprises a portion of frictional material in engagement with the plurality of contacts, the frictional characteristics of the frictional material being such that the contacts will not move with respect thereto when subjected to the accelerative forces encountered in normal handling of a printed circuit board, but that the contacts will move when subjected to a greater force less than that sufficient to provide a permanent deformation of a printed circuit board. Thus the contact elements will move relatively easily on engaging a circuit board and yet will not be displaced on handling. Conveniently the portion of frictional material comprises a single strip engaging all of the electrical contact elements. In one convenient arrangement the strip is formed from an adhesive tape, typically of a plastics material.

The strip is preferably secured directly to the insulating housing. In one convenient arrangement the electrical contacts are of elongate form and extend through the strip. The strip conceivably includes pre-formed apertures adapted to receive the electrical contacts. The frictional characteristics of the material can conveniently be governed by the pre-forming of differing sized or shaped apertures.

Figure 2:
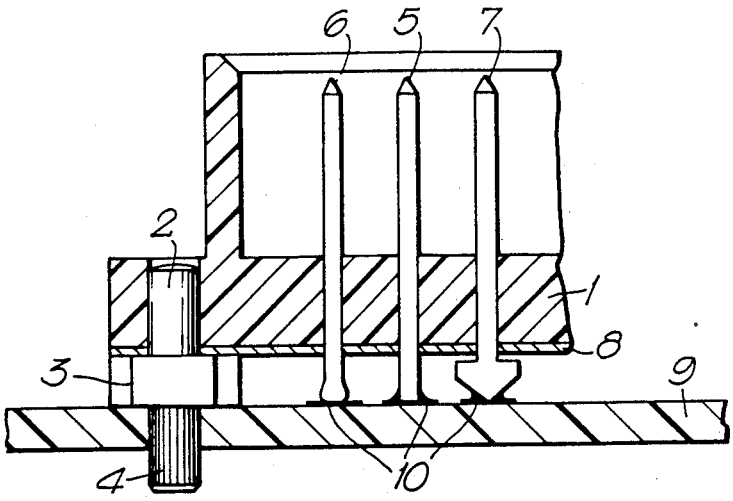

Embodiments of the invention will now be described by way of example with reference to the accompanying drawings in which:

FIG. 1 shows one end of a connector for a printed circuit board prior to attachment to the board and embodying three different types of contact profile, and FIG. 2 shows the connector of FIG. 1 attached to the printed circuit board.

Referring to FIG. 1, the connector, of which only the left hand end is shown, comprises a moulded plastics insulating housing 1 into which is driven the upper plane portion of a metal pin 2. The penetration of the portion 2 is limited by a stop 3 separating the upper portion 2 from a lower, splined portion 4.

The housing is provided with a plurality of holes to receive elongated contacts 5,6,7 which will, for the time being be treated as if they were of identical design. These contacts have a cross-section similar to that of the holes in the housing, which cross-section may be, for example, round or square.

Lying against the bottom of the housing 1 is a friction strip 8 formed, for example, from a plastics tape coated on one side with adhesive so that it can be stuck on to the bottom of the housing. This tape is already provided, for example by pre-punching, with holes corresponding in position to those in the housing 1. The size and configuration of the holes in the tape 8 is chosen so that, although the contacts can slide axially in the holes in the housing, the tape 8 provides a frictional resistance to such sliding. For example, the holes in the tape can be of circular cross-section, while the contacts are of square cross-section or vice-versa.

The connector housing 1 with its contacts 5,6,7 is adapted to be mounted on and fixed to a printed circuit board 9 provided with contact pads 10 coated with solder paste. The board is pierced with through holes 11 corresponding to the splined pin 4 at either end of the connector. When the contacts 5,6,7 are inserted in the connector housing, their lower ends are, as shown in FIG. 1 caused to project beyond the bottom surface of the stop 3.

As shown in FIG. 2, the connector is pressed down onto the printed circuit board and retained in contact therewith by engagement of the splined pin portion 4 in the holes 11. By the time the latter have been fully inserted and the stops 3 have come into contact with the surface of the board the contacts 5,6,7 will have been pushed upwards relative to the housing 1. By virtue, however, of the frictional resistance provided by the tape 8, they will be firmly engaging their respective contact pads 10 and will remain in contact, therewith during handling and subsequent flow-soldering.

The lower ends of the contacts may be left plain as in the case of the contact 5. Alternatively, they may have a "countersunk" profile as in the case of contact 6 or a "spade" profile as in the case of contact 7.

Many other variations can be made within the scope of the invention. For example, other types of interference fit between the tape and the contacts can be envisaged and the thickness of the tape and the type of plastics material from which it is made can be varied to produce the desired frictional characteristics.

It is, of course, necessary to ensure that the frictional loading on the contacts is not so great as to cause permanent deformation of the printed circuit board.

I claim:

1. A connector for a printed circuit board comprising a housing having a plurality of holes accommodating respective elongated contacts one end of which is adapted to make electrical contact with a conductive trace, pad or other conductive surface on the printed circuit board when the connector is brought into contact with the board, characterised in that the contacts (5,6,7) are capable of limited axial movement relative to the housing (1) in order to take up irregularities in the board and that frictional material (8) is provided to cause the contacts to be retained in the positions which they have taken up when the connector is fully engaged with the board (9).

2. A connector for a printed circuit board, comprising:

an insulating housing;

a plurality of substantially rigid electrical contacts received within said housing so as to be freely moveable with respect to said housing in one direction; and a portion of frictional material in engagement with said plurality of contacts, with said contacts being able to move in said one direction on engagement with a printed circuit board, and with said frictional material holding each contact in a range of positions along said direction;

the frictional characteristics of said frictional material being such that the contacts will not move with respect thereto when subjected to the accelerative forces encountered in normal handling of a printed circuit board, but that the contacts will move when subjected to a greater force less than that sufficient to cause a permanent deformation of a printed circuit board.

3. A connector according to claim 2 wherein said portion of frictional material comprises a single strip engaging all the contacts.

4. A connector according to claim 3, wherein said strip is formed from an adhesive tape.

5. A connector according to claim 3, wherein said strip is formed from a plastics material.

6. A connector according to claim 3, wherein said strip is secured directly to the insulating housing.

7. A connector according to claim 3, wherein said electrical contacts are elongated and extend through said strip.

8. A connector according to claim 3, wherein said strip includes pre-formed holes adapted to receive said electrical contacts.

* * * * *